US012600509B2

(12) United States Patent
Tunchel et al.

(10) Patent No.: US 12,600,509 B2
(45) Date of Patent: Apr. 14, 2026

(54) SYSTEM AND METHOD FOR PACKAGING PRODUCE

(71) Applicant: STEPAC L.A. LTD., Tefen (IL)

(72) Inventors: Ivo Tunchel, Sao Paulo (BR); Gary Ward, Tefen (IL); Asaf Shachnai, Tefen (IL)

(73) Assignee: STEPAC L.A. LTD., Tefen (IL)

( * ) Notice: Subject to any disclaimer, the term of this patent is extended or adjusted under 35 U.S.C. 154(b) by 1 day.

(21) Appl. No.: 18/715,822

(22) PCT Filed: Nov. 29, 2022

(86) PCT No.: PCT/IL2022/051269
§ 371 (c)(1),
(2) Date: Jun. 3, 2024

(87) PCT Pub. No.: WO2023/105512
PCT Pub. Date: Jun. 15, 2023

(65) Prior Publication Data

US 2025/0033813 A1 Jan. 30, 2025

Related U.S. Application Data

(60) Provisional application No. 63/287,577, filed on Dec. 9, 2021.

(51) Int. Cl.
*B65B 25/04* (2006.01)
*B65B 9/10* (2006.01)
(Continued)

(52) U.S. Cl.
CPC ..... *B65B 25/048* (2013.01); *B65B 9/10* (2013.01); *B65B 39/002* (2013.01); *B65B 39/06* (2013.01);
(Continued)

(58) Field of Classification Search
CPC ..... B65B 9/10; B65B 25/04; B65B 25/048; B65B 39/002; B65B 39/06; B65B 39/08;
(Continued)

(56) References Cited

U.S. PATENT DOCUMENTS 2,285,279 A * 6/1942 Hohl et al. ..... B65B 43/54 141/315
3,040,966 A * 6/1962 Crane ..... B65D 29/04 383/118
(Continued)

FOREIGN PATENT DOCUMENTS

GB 2573779 A * 11/2019 ..... B65B 9/06
WO WO-2009128731 A1 * 10/2009 ..... D04B 9/42

OTHER PUBLICATIONS

Search Report and Written Opinion of PCT/IL2022/051269 Completed Jan. 29, 2023; Mailed Jan. 29, 2023.

*Primary Examiner* — Stephen F. Gerrity
(74) *Attorney, Agent, or Firm* — The Roy Gross Law Firm, LLC; Roy Gross

(57) ABSTRACT

The present disclosure generally relates to a system and method to pack and convey fresh produce, in particular, for flow packing produce with an aerated packaging material into package bundles of produce prior to sealing thereof for handling and delivery.

17 Claims, 15 Drawing Sheets

(51) Int. Cl.

| | |
|---|---|
| ***B65B 39/00*** | (2006.01) |
| ***B65B 39/06*** | (2006.01) |
| ***B65B 39/08*** | (2006.01) |
| ***B65B 43/52*** | (2006.01) |
| ***B65B 43/54*** | (2006.01) |
| ***B65B 51/08*** | (2006.01) |
| ***B65B 61/28*** | (2006.01) |
| ***B65D 30/00*** | (2006.01) |
| ***B65D 30/06*** | (2006.01) |
| ***B65D 33/16*** | (2006.01) |
| ***B65D 85/34*** | (2006.01) |

(52) U.S. Cl.
CPC ..... *B65B 39/08* (2013.01); *B65B 43/52* (2013.01); *B65B 43/54* (2013.01); *B65B 51/08* (2013.01); *B65B 61/28* (2013.01); *B65D 29/00* (2013.01); *B65D 29/04* (2013.01); *B65D 33/16* (2013.01); *B65D 85/34* (2013.01); *B65D 85/345* (2013.01); *B65B 2220/20* (2013.01)

(58) Field of Classification Search
CPC ..... B65B 43/52; B65B 43/54; B65B 51/08; B65B 61/28; B65B 2220/20; B65D 29/00; B65D 29/04; B65D 33/16; B65D 85/34; B65D 85/345
USPC ..... 53/469, 574–579, 284.7
See application file for complete search history.

(56) References Cited

U.S. PATENT DOCUMENTS

| | | | | | |
|---|---|---|---|---|---|
| 3,209,515 | A * | 10/1965 | Harpenau | B65B 25/04 | 53/247 |
| 3,578,236 | A * | 5/1971 | Arai et al. | B65D 33/30 | 383/905 |
| 3,630,759 | A * | 12/1971 | Rumberger | A23B 7/148 | 426/415 |
| 4,791,776 | A * | 12/1988 | Jackman et al. | B65B 1/06 | 141/10 |
| 4,947,625 | A * | 8/1990 | Zike | B65B 9/13 | 53/567 |
| 5,146,731 | A * | 9/1992 | Marshall et al. | B65B 5/067 | 53/374.3 |
| 5,544,781 | A * | 8/1996 | Mattesky | D06F 95/002 | 220/9.4 |
| 5,779,894 | A * | 7/1998 | Martensson | B65D 81/261 | 383/41 |
| 5,803,704 | A | 9/1998 | Lazzarotti | | |
| 8,033,084 | B1 | 10/2011 | Peterson et al. | | |
| 2016/0318665 | A1 * | 11/2016 | Springer | B65D 85/808 | |

* cited by examiner

SYSTEM AND METHOD FOR PACKAGING PRODUCE

CROSS REFERENCE TO RELATED APPLICATIONS

This application is a National Phase of PCT Patent Application No. PCT/IL2022/051269 having International filing date of Nov. 29, 2022, which claims the benefit of priority of U.S. Provisional Patent Application No. 63/287,577, filed Dec. 9, 2021, the contents of which are all incorporated herein by reference in their entirety.

FIELD OF INVENTION

The present disclosure generally relates to a system and method to pack and convey fresh produce, in particular to package bundles of produce for delivery.

BACKGROUND

Flow packing is a convenient and cost-effective method for preserving food and produce by sealed packing the same in a flexible packaging, typically made of plastic. The packaging and subsequent sealing by the flow packing process ensures protection of enclosed goods from the elements during the supply chain, which is particularly suitable when delicate or sensitive produce is distributed long distances, such as to international markets.

Packaging components for smaller produce (for example cherries) often include rigid plastic trays that directly contain the produce in order to prevent unnecessary scattering of the produce during the packing process. The trays are likewise useful for mitigating damage and ensuring an aesthetically pleasing display of the produce to the end customer. However, the extra inclusion of these trays is both (i) cost inefficient, as the extra cost of producing them and transporting their additional weight must be added to the overall processing costs, and (ii) not environmentally responsible, since the ongoing need to produce them results in a larger carbon footprint.

Therefore, a need exists for a process in which the small produce can be contained prior to flow packing, without the need for such trays.

SUMMARY OF THE INVENTION

According to some embodiments, there are provided herein a method and a system for flow packing produce with an aerated packaging material prior to sealing thereof for handling and delivery. According to some embodiments, the aerated packaging material may also be flexible. According to some embodiments, the aerated packaging material may be lightweight. According to some embodiments, the aerated packaging material may include a net. According to some embodiments, the aerated packaging material may include a perforated paper. According to some embodiments, the aerated packaging material may be synthetic and/or natural. According to some embodiments, the aerated packaging material may be woven and/or non-woven polypropylene.

According to some embodiments, there is provided herein a scaffold having upper edges and a "produce outlet opening". Optionally, the "produce outlet opening" may include a front opening, rear opening, side opening, or bottom opening, such as a door, flap, trap door, at least partial absence of a side, front, rear or bottom of the scaffold. Each option is a separate embodiment. Optionally, the produce outlet opening may be symmetrical or asymmetrical. According to some embodiments, the scaffold may be reusable.

According to some embodiments, the scaffold may have a frame structure and/or may be shaped like a box and/or like a "boat". Optionally, the scaffold may be constructed from plastic, cardboard, wood, metal, silicone, any other appropriate material, and/or any combination thereof. Each option is a separate embodiment. According to some embodiments, the scaffold may be rigid enough to support the aerated packaging material and/or the produce.

According to some embodiments, the scaffold may have at least one rail. Optionally, the rail may protrude from, indented within and/or be attached to an outer surface of the scaffold. Optionally, the scaffold may include two rails mounted on the outer surfaces of two parallel sides of the scaffold. Optionally, the rail may be a lip and/or rim on an outer surface of the scaffold. Optionally, the rail may be made of plastic, cardboard, wood, metal, silicone, any other appropriate material, and/or any combination thereof. Each option is a separate embodiment.

According to some embodiments, the aerated packaging material may be configured for closing by an elastic band. According to some embodiments, the aerated packaging material may be configured to maintain a group of produce together in a bundle, e.g., net, cloth pouch or bag, etc. Optionally, the elastic band may be placed over the upper edges of the scaffold.

According to some embodiments, the scaffold and/or aerated packaging material may be used in packing processes as follows: the first step includes a scaffold bearing an aerated packaging material placed manually or automatically on the packing line. In the second step, produce (for example cherries, but may be any type of produce, such as, but not limited to, cherry tomatoes, apricots, green beans, peas, nectarines, peaches, pomegranates, cherries, apples, plums, oranges, mandarins, lemons, peppers, carrots, cucumbers, etc.) may be deposited inside the aerated packing material. In the third step, the scaffold bearing the aerated packaging material and produce may proceed along a conveyer belt as a single unit to the flow pack machine. The scaffold bearing the aerated packaging material and produce may then be lifted (for example, automatically lifted by grasping and lifting one or more rails or protrusions on one or more sides of the scaffold). The action of lifting the scaffold may cause the aerated packaging material bearing the bundled produce to be dropped through the opening of the scaffold (for example through the false door), and optionally simultaneously, the weight of the produce may cause the aerated packaging material to be released from the upper edges of the scaffold, which may result in contraction of the opening (the mouth) of the aerated packaging material (for example, by contraction of an elastic band), which may then encloses the produce. This may occur at the entrance to a flow pack machine. The resulting produce enclosed by the aerated packaging material may then be sealed by packaging in the flow pack machine, optionally with a modified atmosphere, resulting in a package appropriate for distribution. The empty scaffold may be reused by returning it to the beginning of the flow process following produce packing. Optionally, the empty scaffold may be returned to the beginning of the flow process using one or more conveyor belts running above, below or parallel to the packing line.

Advantageously, the flow packing process, which utilizes a scaffold having a produce outlet opening and a closable aerated packing material, in accordance with some embodiments, may facilitate the bundling and protection of the produce during the packing process and/or re-usability of the scaffold, which may result in a reduction of the carbon footprint of the overall packaging process. Furthermore, the cost and/or the weight of the packed produce may be reduced.

Moreover, in accordance with some embodiments of the flow packaging process, the final packaging with an aerated packaging material may allow for reduced bulk of the overall final product, which may allow a greater volume of produce to be packed and distributed. Additionally, and/or alternatively, in some embodiments, the flow packaging process may include modified atmosphere properties (MAP). Optionally, the packaged produce may be enclosed in a modified atmosphere. Advantageously, the aerated packaging material may allow a modified atmosphere free access to the produce within a package. Optionally, the aerated packaging material may provide an efficient means of grouping a specific number and/or weight of produce together for further packaging under modified atmosphere conditions. Optionally, the final packaging may increase the shelf life of the produce. Optionally, the final packaging may reduce and/or prevent deterioration in quality due to microbial decay. Advantageously, the aerated packaging utilized in accordance with some embodiments, may improve air flow in the final packaging over traditional packaging, such as a box, tray or boat which impede air flow.

Advantageously, the color of the aerated packaging material may be used for modifying the visual appearance of the produce, which may make the produce more desirable to the end customer. For example, using a red aerated packaging material may enhance the color of red cherries packed within.

Some embodiments relate to a produce packaging system which may include:

- a scaffold including an upper edge and a produce outlet opening, wherein the upper edge may be configured to hold open an aerated packaging material configured to receive, confine and enclose produce; and
- a conveyer system configured to facilitate at least two configurations of the scaffold, wherein in a first configuration, produce confined within the aerated packaging material may be prevented from exiting through the produce outlet opening, and wherein in a second configuration, exiting of produce enclosed within the aerated packaging material may be facilitated through the produce outlet opening.

According to some embodiments, the aerated packaging material may be configured to confine a group of produce together in a bundle, e.g., the aerated packaging material may be configured for closing by an elastic material. According to some embodiments, the aerated packaging material or the elastic material may enclose the produce. Optionally, the aerated packaging material may be a net, bag, or pouch. Optionally, the aerated packaging material may be composed of a polymer, woven natural material (e.g., plant or animal material), woven animal material, fibers, flax, hemp, straw, cotton, silk, and/or any combination thereof.

According to some embodiments, the produce outlet opening may be a front opening, rear opening, side opening, bottom opening and/or any combination thereof. Optionally, the produce outlet opening may be symmetrical or asymmetrical.

According to some embodiments, the produce outlet opening may include a door, flap, trap door, at least partial absence of a side, front, rear or bottom of the scaffold. Optionally, the door, flap or trap door may be composed of a flexible, semi-flexible or rigid material.

According to some embodiments, the produce outlet opening may include a produce support ramp extending from the scaffold and may be configured to dampen the exit of the produce enclosed within the aerated packaging material through the produce outlet opening.

According to some embodiments, the scaffold may have at least one rail protruding from, indented within or attached to an outer surface of the scaffold, wherein the at least one rail may be configured to support the scaffold in the first configuration, in the second configuration and/or in a transition between the first and the second configurations. Optionally, the scaffold may be constructed from plastic, cardboard, wood, metal, silicone, and/or any combination thereof. Optionally, the scaffold may be reusable.

According to some embodiments, a method for packaging produce may include:

- positioning on a surface a scaffold comprising an upper edge and a produce outlet opening;
- placing an aerated packaging material over the upper edge of the scaffold;
- introducing produce through the upper edge and into the aerated packaging material, such that the produce may be confined within the aerated packaging material;
- separating the scaffold from the surface and/or changing an inclination of the scaffold, such that the weight of the produce may push the produce confined within the aerated packaging material out from the produce outlet opening; thereby the aerated packaging material confining the produce therein may be released from the upper edge of the scaffold enclosing the produce therein.

According to some embodiments, the aerated packaging material bearing the enclosed produce may be deposited onto a conveyer belt for further packaging.

According to some embodiments, the aerated packaging material containing the enclosed produce may be sealed in a polymer packaging by a flow packing process. Optionally, the enclosed produce may be packaged by a flow packaging process immediately after being released from the scaffold. Optionally, the flow packing process may include modified atmosphere properties. Optionally, the packaged produce may be placed in an outer carton and/or palletized for distribution.

According to some embodiments, the produce outlet opening may be located on the bottom of the scaffold opposing the upper edge and wherein the produce outlet opening may be blocked when the scaffold is placed on the surface. According to some embodiments, upon separating between the scaffold and the surface, the produce outlet opening may be unblocked, allowing the weight of the produce within the aerated packaging material to push the enclosed produce out therethrough.

According to some embodiments, separating between the scaffold and the surface may be performed by lifting the scaffold and/or supporting the scaffold while removing the surface on which the scaffold may be positioned. Optionally, the scaffold may be lifted or supported utilizing at least one rail of the scaffold. Optionally, the scaffold may have at least one rail protruding from, indented within and/or attached to an outer surface of the scaffold. According to some embodiments, the at least one rail may be configured to support the scaffold in the first configuration, in the second configuration and/or in a transition configuration between the first configuration and the second configuration.

According to some embodiments, the produce outlet opening may be located on a front, rear or side of the scaffold essentially perpendicularly to the upper edge and wherein the produce within the aerated packaging material may be maintained within the scaffold when the scaffold is placed horizontally on a surface.

According to some embodiments, upon changing the inclination of the scaffold, the weight of the produce within the aerated packaging material may push the enclosed produce out from the produce outlet opening.

According to some embodiments, the aerated packaging material may be configured to confine a group of produce together in a bundle. According to some embodiments, the aerated packaging material is configured for closing by an elastic material. Optionally, contraction of the aerated packaging material and/or the elastic material may enclose the produce. Optionally, the aerated packaging material may be a net, bag, or pouch. Optionally, the aerated packaging material may be composed of a polymer, woven natural material, fibers, flax, hemp, straw, cotton, silk, wool, paper, or any combination thereof. Optionally, the aerated packaging material bearing the enclosed produce may be deposited onto a conveyer belt manually or automatically.

According to some embodiments, the scaffold may be constructed from plastic, cardboard, wood, metal, silicone, and/or any combination thereof. Optionally, the scaffold may be reusable. According to some embodiments, the scaffold may be returned to the start of the process after the produce enclosed within the aerated packaging material through the produce outlet opening.

Some embodiments relate to a scaffold for packaging produce including:

an upper edge configured to hold open an aerated packaging material configured to receive, confine and enclose produce;

a produce outlet opening; and at least one rail protruding from, indented within or attached to an outer surface of the scaffold, wherein the scaffold may be adapted for at least two configurations, wherein in a first configuration, produce confined within the aerated packaging material may be prevented from exiting through the opening, and wherein in a second configuration, exit of produce enclosed within the aerated packaging material may be facilitated through the produce outlet opening, wherein at least one rail may be configured to support the scaffold in the first configuration, in the second configuration and/or in a transition between the first and the second configurations.

According to some embodiments, the aerated packaging material may be configured to confine a group of produce together in a bundle. Optionally, the aerated packaging material may be configured for closing by an elastic material. According to some embodiments, contraction of the aerated packaging material and/or the elastic material may enclose the produce. Optionally, the aerated packaging material may be a net, bag, or pouch. Optionally, the aerated packaging material may be composed of a polymer, woven natural material (e.g., plant or animal material), fibers, flax, hemp, straw, cotton, silk, wool, paper, and/or any combination thereof.

According to some embodiments, the produce outlet opening may be a front opening, rear opening, side opening, bottom opening or any combination thereof. Optionally, the produce outlet opening may be symmetrical or asymmetrical.

According to some embodiments, the produce outlet opening may include a door, flap, trap door, at least partial absence of a side, front, rear or bottom of the scaffold. Optionally, the door, flap or trap door may be constructed from a flexible, semi-flexible or rigid material.

According to some embodiments, the produce outlet opening may include a produce support ramp extending from the scaffold which may be configured to dampen the exit of the produce enclosed within the aerated packaging material through the produce outlet opening.

According to some embodiments, the scaffold may be constructed from plastic, cardboard, wood, metal, silicone, and/or any combination thereof. Optionally, the scaffold may be reusable. According to some embodiments, the scaffold may be returned to the start of the process after the produce enclosed within the aerated packaging material through the produce outlet opening.

According to some embodiments, the enclosed produce may undergo further packaging. According to some embodiments, the aerated packaging material containing the enclosed produce may be sealed in a polymer packaging by a flow packing process. Optionally, the flow packing process may be with modified atmosphere properties. Optionally, the packaged produce may be placed in an outer carton and/or palletized for distribution.

Certain embodiments of the present disclosure may include some, all, or none of the above advantages. One or more technical advantages may be readily apparent to those skilled in the art from the figures, descriptions and claims included herein. Moreover, while specific advantages have been enumerated above, various embodiments may include all, some, or none of the enumerated advantages.

BRIEF DESCRIPTION OF THE DRAWINGS

Some embodiments of the disclosure are described herein with reference to the accompanying figures. The description, together with the figures, makes apparent to a person having ordinary skill in the art how some embodiments may be practiced. The figures are for the purpose of illustrative description, and no attempt is made to show structural details of an embodiment in more detail than is necessary for a fundamental understanding of the disclosure. For the sake of clarity, some objects depicted in the figures are not to scale.

In the Figures.

DETAILED DESCRIPTION

Figure 1:
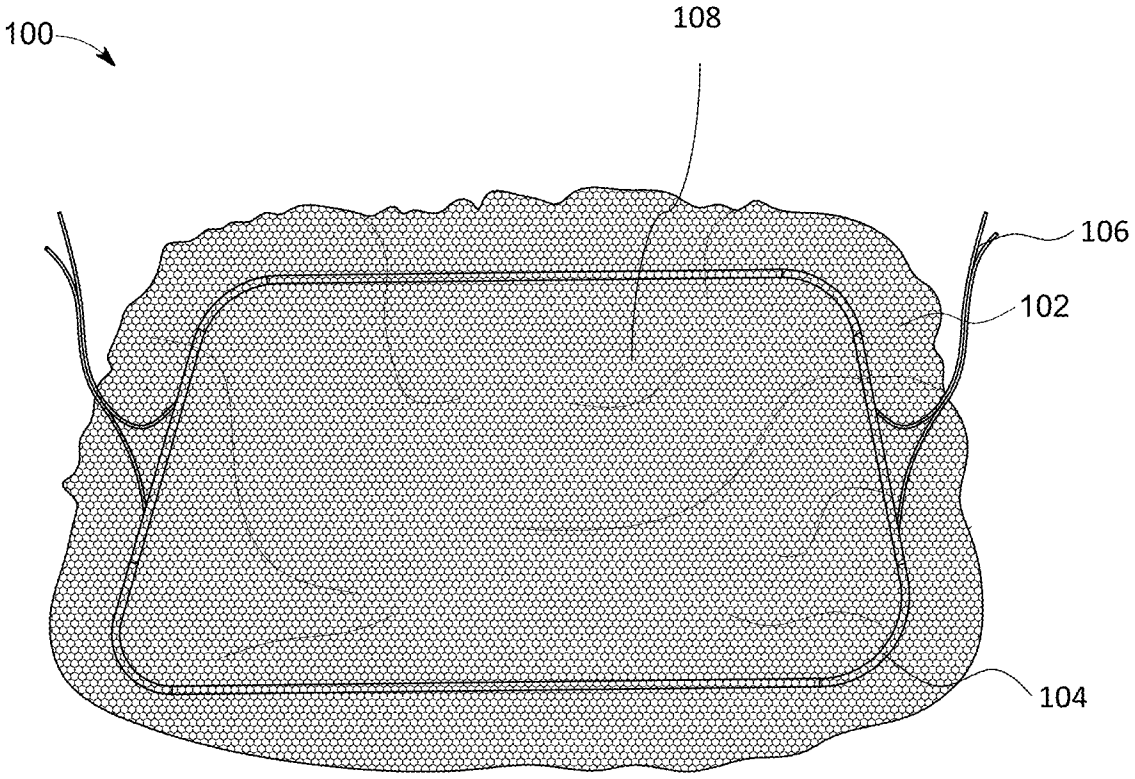
FIG. 1 schematically shows perspective view of an aerated packaging material for produce bundling for packaging, according to some embodiments.

In the following description, various aspects of the disclosure will be described. For the purpose of explanation, specific configurations and details are set forth in order to provide a thorough understanding of the different aspects of the disclosure. However, it will also be apparent to one skilled in the art that the disclosure may be practiced without specific details being presented herein. Furthermore, well-known features may be omitted or simplified in order not to obscure the disclosure.

According to some embodiments, there are provided herein a method and a system for flow packing produce with an aerated packaging material prior to sealing thereof for handling and delivery.

The term "produce" is defined herein as any agricultural product, preferably a plant or fungus based agricultural product, such as an herb, seed, root, stem, fruit or vegetable. Optionally, the produce may be a fruit body, root, tuber, seed, stem, leaf, or flower. Optionally, any type of produce may be used, such as, but not limited to: cherry tomato, fig, apricot, green bean, pea, nectarine, peach, pomegranate, cherry, grape, pear, apple, plum, orange, grapefruit, mandarin, lemon, pepper, carrot, cucumber, coconut, artichoke, pumpkin, onion, garlic, broccoli, cauliflower, nut, bean, mango, zucchini, eggplant, fennel, radish, mushroom, lettuce, kale, celery, parsley, coriander, etc. Optionally, a mixture of different types of produce may be packaged together, e.g., ingredients for a soup, salad, juice, etc.

According to some embodiments, the scaffold may include any structure that is configured to support the aerated packaging material and accommodate the produce therein. The scaffold may have a frame structure or may be shaped like a box and/or like a "boat". Optionally, the scaffold may comprise plastic, cardboard, wood, metal, silicone, any other appropriate material, and/or any combination thereof. Each option is a separate embodiment. Preferably, the scaffold may be rigid enough to support the aerated packaging material and/or the produce.

According to some embodiments, the scaffold may include an upper edge and a produce outlet opening. Optionally, the upper edge may be configured to hold open an aerated packaging material. Optionally, the scaffold may have one or more configurations. Optionally, the scaffold may have at least two configurations. Optionally, in a first configuration of the scaffold, produce confined within the aerated packaging material may be prevented from exiting through the produce outlet opening. Optionally, in a second configuration of the scaffold, exit of produce enclosed within the aerated packaging material through the produce outlet opening may be facilitated.

According to some embodiments, the scaffold may have at least one rail. Optionally, the rail may protrude from, indent within or be attached to an outer surface of the scaffold. Optionally, the scaffold may include two rails mounted on the outer surfaces of two parallel sides of the scaffold. Optionally, the rail may be a lip and/or rim on an outer surface of the scaffold. Optionally, the rail may comprise plastic, cardboard, wood, metal, silicone, any other appropriate material, and/or any combination thereof. Each option is a separate embodiment. Optionally, the one or more rails may be configured to be used to lift the scaffold.

Optionally, the one or more rails may be configured to be used to support the scaffold. Optionally, the scaffold may be rigid.

According to some embodiments, the scaffold may be placed on a surface (e.g., a work surface, conveyer belt, etc.). Optionally, the surface may block one or more produce outlet openings of the scaffold. Optionally, the scaffold may be separated from the surface by lifting the scaffold, changing the inclination of the scaffold, removing the surface from under the scaffold, etc. Each possibility is a separate embodiment.

According to some embodiments, the produce outlet opening may be located on the bottom of the scaffold opposite the upper edge. Optionally, the produce outlet opening may be blocked when the scaffold is placed on a surface. Optionally, upon separating the scaffold from the surface, the produce outlet opening may be unblocked, thereby allowing the weight of the produce within the aerated packaging material to push the enclosed produce out through the produce outlet opening. Optionally, the separating between the scaffold and the surface may be performed by lifting the scaffold and/or supporting the scaffold while removing the surface on which the scaffold may be positioned. Optionally, the scaffold may be lifted and/or supported utilizing at least one rail of the scaffold.

According to some embodiments, the produce outlet opening may be located on a side of the scaffold at an angle to and/or essentially perpendicular to the upper edge. Optionally, the produce within the aerated packaging material may be maintained within the scaffold when the scaffold is placed horizontally on the surface. Optionally, upon changing the inclination of the scaffold, the weight of the produce within the aerated packaging material may push the enclosed produce out from the produce outlet opening. Optionally, upon changing the angle of the scaffold with respect to the horizontal surface, the weight of the produce within the aerated packaging material may push the enclosed produce out from the produce outlet opening. For example, tipping the scaffold and/or lifting the scaffold at an angle to allow the weight of the produce within the aerated packaging material to push the enclosed produce out from a produce outlet opening (e.g., located on a side of the scaffold).

According to some embodiments, the scaffold may be reusable.

According to some embodiments, the aerated packaging material may be configured for closing by an elastic band. According to some embodiments, the aerated packaging material may comprise an elastic material. According to some embodiments, the aerated packaging material may be configured to maintain a group of produce together in a bundle, e.g., net, pouch, bag, etc.

According to some embodiments, the aerated packaging material may comprise of a synthetic and/or natural material. According to some aspects of the present disclosure, the aerated packing material, for example a net, bag, or pouch may be composed of a polymer, such as polypropylene, woven natural material, fibers (for example, flax, hemp, straw, cotton, paper, silk, wool, etc.), any appropriate material, and/or combinations thereof. Each possibility is a separate embodiment.

According to some embodiments, the aerated packaging material may possess a single opening with an elastic material, e.g., elastic band, tie, etc., which may enable the aerated packaging material to close.

According to some embodiments, the placement of the aerated packaging material in the scaffold may be performed manually prior to and/or during placement of the scaffold on the conveyor belt. Optionally, the produce may be placed in the aerated packaging material without use of a scaffold. Optionally, produce enclosed by the aerated packaging material may be placed directly onto a conveyer belt for further packaging. Optionally, an elastic band at the opening of the aerated packaging material may be placed over the upper edges of the scaffold. Optionally, the elastic opening of the elastic aerated packaging material may be placed over the upper edges of the scaffold.

According to some embodiments, the scaffold and aerated packaging material may be used in packing processes as follows: a first step may include a scaffold bearing an aerated packaging material placed manually and/or automatically on the packing line. In a second step, produce (for example cherries, but may be any type of produce, such as, but not limited to, cherry tomatoes, apricots, green beans, peas, nectarines, peaches, pomegranates, cherries, apples, plums, oranges, mandarins, lemons, peppers, carrots, cucumbers, nuts, etc.) may be deposited inside the aerated packing material. In the third step, the scaffold bearing the aerated packaging material and produce may proceed along a conveyer belt as a single unit to the flow pack machine. The scaffold bearing the aerated packaging material and produce may then be lifted (for example, automatically lifted by grasping and lifting the scaffold using one or more rails or protrusions on one or more sides of the scaffold). The action of lifting the scaffold may cause the aerated packaging material bearing the bundled produce to drop through the opening of the scaffold (for example through the produce outlet opening), and optionally simultaneously, the weight of the produce may cause the aerated packaging material to be released from the upper edges of the scaffold, which may result in contraction of the opening (the mouth) of the aerated packaging material (for example, by contraction of an elastic band or the elastic material of the aerated packaging material), which may then enclose the produce. The resulting produce enclosed by the aerated packaging material may then be sealed by packaging in the flow pack machine, resulting in a package which may be appropriate for distribution. The empty scaffold may be reused by returning it to the beginning of the flow process following produce packing.

In addition to the exemplary aspects and embodiments described above, further aspects and embodiments will become apparent by reference to the figures and by study of the following detailed descriptions.

Reference is now made to the figures.

FIG. 1 schematically shows a perspective view of an aerated packaging material 100 (in this case a net but may be any type of other aerated packing material) for produce bundling for packaging, according to some embodiments. Optionally, the aerated packaging material may include a single opening lined with an elastic band and/or may be constructed from an elastic material, making it suitable to spontaneously enclose produce (in this case cherries, but may include other kinds of produce) placed in the aerated packaging material through the mouth 108. Optionally, the aerated packaging material 102 may be held open by an upper edge and/or lip of a scaffold 104. Optionally, the aerated packaging material may include an elasticated material and/or tie which may be stretched over the upper edge of the scaffold which may hold it in place, e.g., elastic band 106. Optionally, the aerated packaging material itself may be made completely or in part from an elastic material.

Figure 2A:
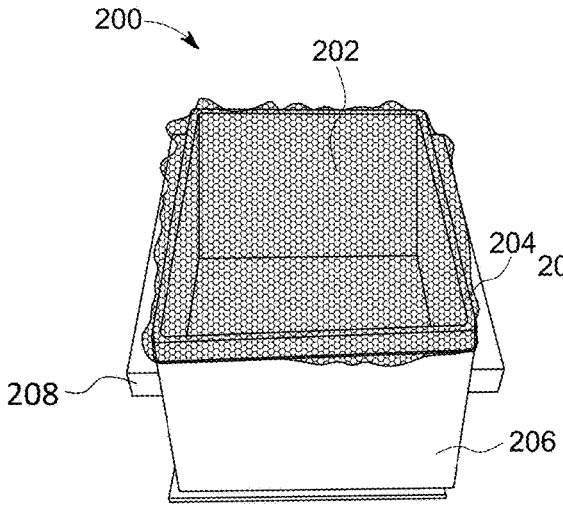
FIG. 2*a* schematically shows a perspective view of an aerated packaging material for bundling produce for packaging within a scaffold, according to some embodiments.
Figure 2B:
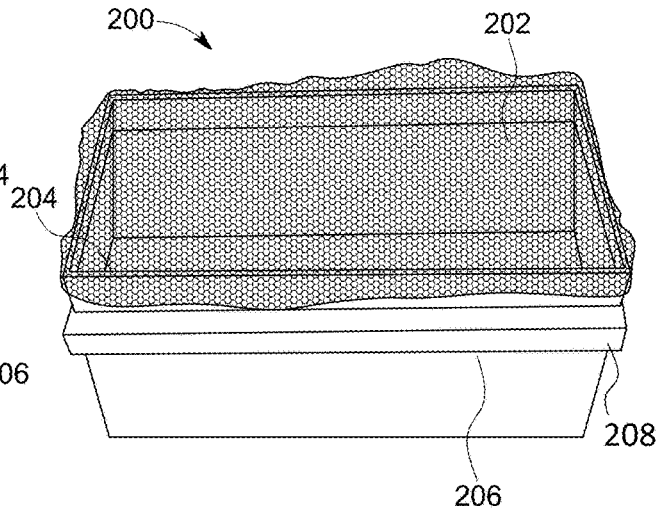
FIG. 2*b* schematically shows a perspective view of an aerated packaging material for bundling produce for packaging within a scaffold, according to some embodiments.
Figure 2C:
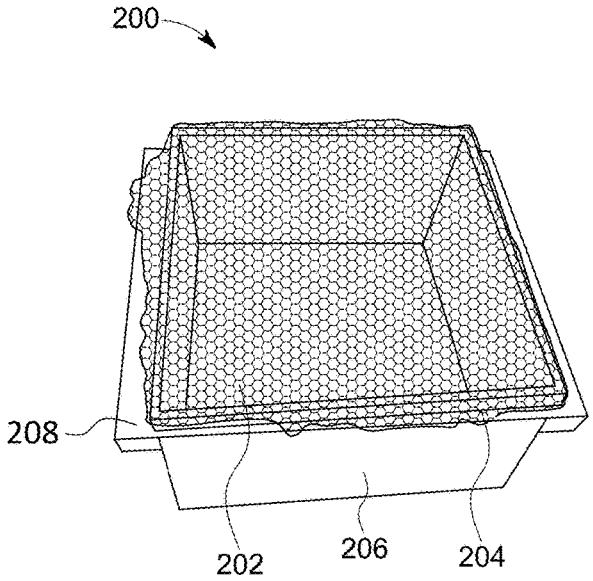
FIG. 2*c* schematically shows a perspective view of an aerated packaging material for bundling produce for packaging within a scaffold, according to some embodiments.
Figure 2D:
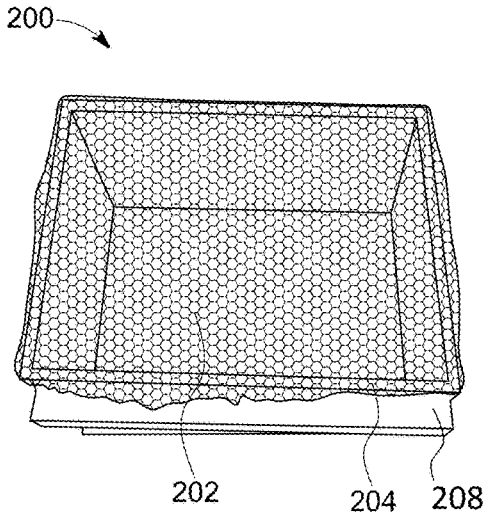
FIG. 2*d* schematically shows a perspective view of an aerated packaging material for bundling produce for packaging within a scaffold, according to some embodiments.

FIG. 2*a*-2*d* schematically show various views of a produce packaging system 200 including an aerated packaging material for containing produce for packaging within a scaffold for flow packaging produce. Optionally, the aerated packaging material may be a woven, knit, and/or knotted material of open texture with evenly spaced holes. Optionally, the aerated packaging material may comprise various mesh sizes (FIG. 2*a-b* v. FIG. 2*c-d*). Optionally, the mesh may be selected according to the size of the produce. Optionally, the mesh size may be selected from mesh with a pores size in the range between about 20 μm to about 100 μm, in the range between about 100 μm to about 1,000 μm, in the range between about 1,000 μm to about 0.1 mm, in the range between about 0.1 mm to about 1 mm, in the range between about 1 mm to about 10 mm, in the range between about 10 mm to about 25 mm, in the range between about 25 mm to about 50 mm, or in the range between about 50 mm to about 100 mm. Each possibility is a separate embodiment.

For example, the aerated packaging material 202 may be placed over an upper edge and/or lip of a scaffold 206. Optionally, the scaffold 206 may include a rail 208, which may be located below the upper edge and/or lip of a scaffold 206 over which the aerated packaging material 202 may fit.

Figure 3A:
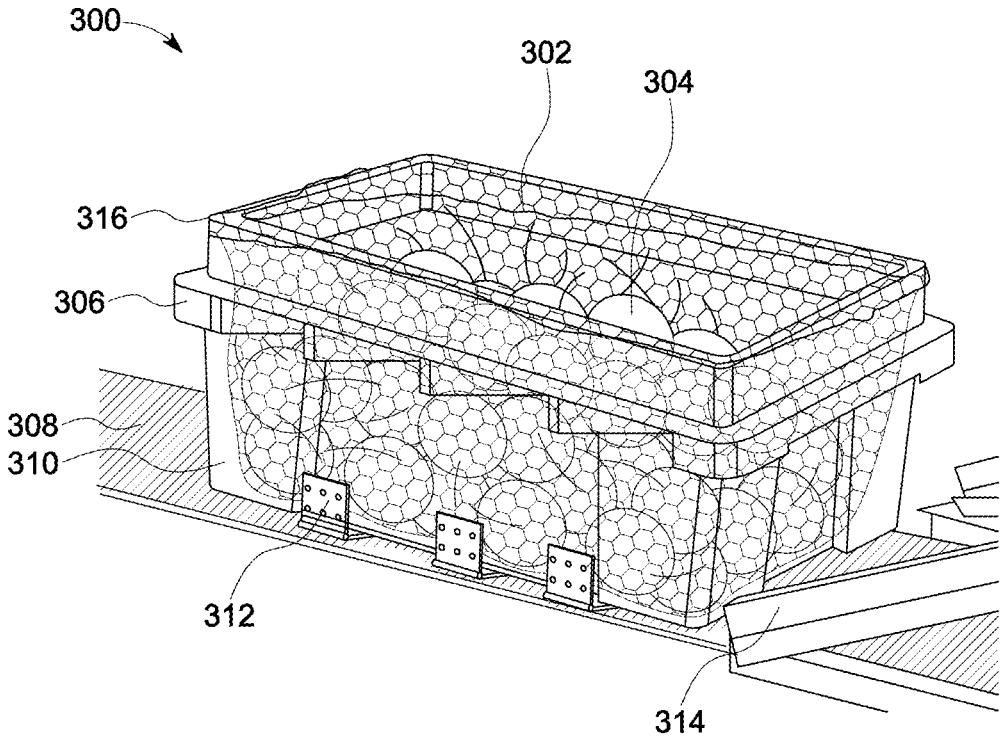
FIG. 3*a* schematically shows a scaffold with an aerated packaging material containing produce on a (flow) packaging conveyer belt, where the scaffold has a symmetrically opening trap door at the bottom thereof (shown in a closed configuration), according to some embodiments.

FIG. 3*a* schematically shows a produce packaging system 300 including a scaffold, according to some embodiments. Optionally, the scaffold 310 may include a rail 306, which may be located below the upper edge 316 and/or lip of a scaffold 310 over which the aerated packaging material 302 may fit. Optionally, the scaffold 310 may include an aerated packaging material 302 containing produce 304, which may be used for flow packaging produce, where the scaffold 310 has a symmetrical and/or asymmetrical produce outlet opening (not shown) e.g., at the bottom. Optionally, the produce outlet opening may be a symmetrical trap door on the bottom of the scaffold. Optionally, the produce outlet opening may include a hinge, fold, flap, etc. 312 attached to one or more edges of the scaffold. Optionally, a hinge, fold, flap, etc. 312 may be absent. Optionally, the produce outlet opening may have at least two configurations: closed and open. Optionally, in the closed configuration, the produce outlet opening may be closed, locked, or held closed by placing it on a surface e.g., a conveyer belt 308. Optionally, the scaffold may be lifted by a frame 314 connected to the conveyer belt 308.

Figure 3B:
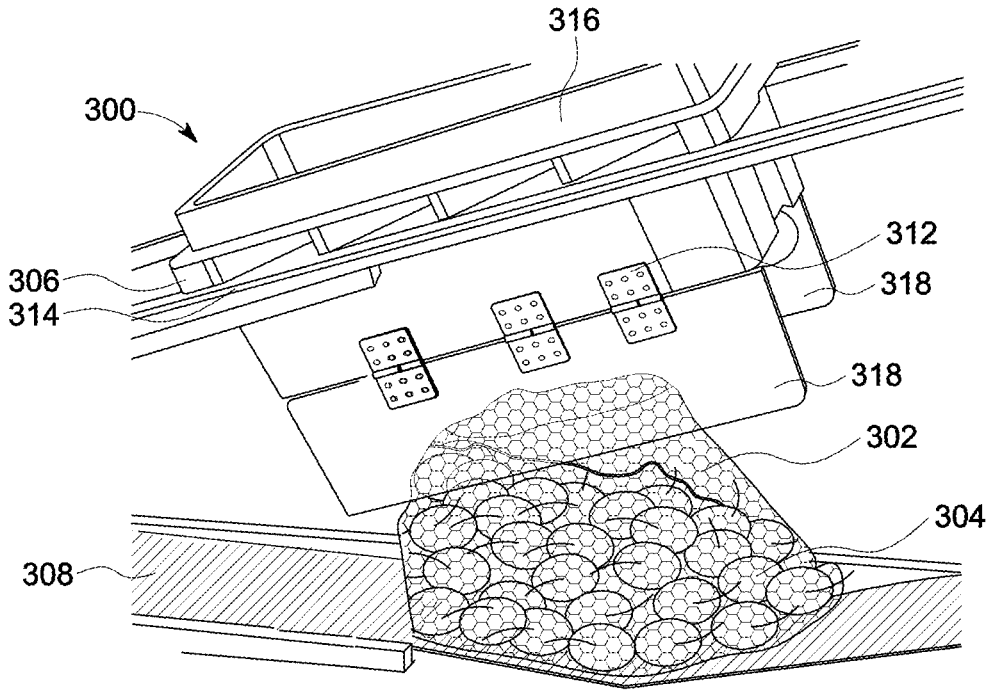
FIG. 3*b* schematically shows the scaffold of FIG. 3*a*, where the symmetrically opening trap door at the bottom thereof is shown in an open configuration, according to some embodiments.

FIG. 3*b* schematically shows a scaffold 310 with an aerated packaging material containing produce, where the scaffold 310 has a symmetrical and/or asymmetrical produce outlet opening 318 e.g., at the bottom, which may be open, according to some embodiments. Optionally, the produce outlet opening 318 may have at least two configurations: closed and open. Optionally, the produce outlet opening 318 may be opened and/or closed and/or locked open or closed. Optionally, the produce outlet opening 318 may be a symmetrical trap door on the bottom of the scaffold which may be in an open configuration. Optionally, the produce outlet opening 318 may include a hinge, fold, flap, etc. 312 attached to one or more edges of the scaffold. Optionally, the produce outlet opening 318 may comprise a flexible, semi-flexible or rigid material. Optionally, the produce outlet opening 318 may comprise a different material or a different weight of material to the rest of the scaffold. Advantageously, the produce outlet opening 318 may be configured to assist in the gentle placement of the produce 304 onto the conveyer belt 308 to reduce and/or prevent damage to the produce, e.g., bruising, breaking, splitting, etc.

For example, a scaffold 310 bearing a aerated packaging material 302 containing produce 304 may be lifted (for example, automatically lifted by grasping and lifting 314 the scaffold 310 using one or more rails 306, indents or protrusions on one or more sides of the scaffold). The action of lifting the scaffold 310 may cause the aerated packaging material 302 bearing the contained produce 304 to drop through the produce outlet opening 318 at the bottom of the scaffold onto a conveyer belt 308. Optionally, the weight of the produce 304 may cause the aerated packaging material 302 to be released from the upper edges 316 of the scaffold 310, resulting in contraction of the opening (the mouth) of the aerated packaging material (for example, by contraction of an elastic band and/or the aerated packing material), which may then enclose the produce 304.

Figure 3C:
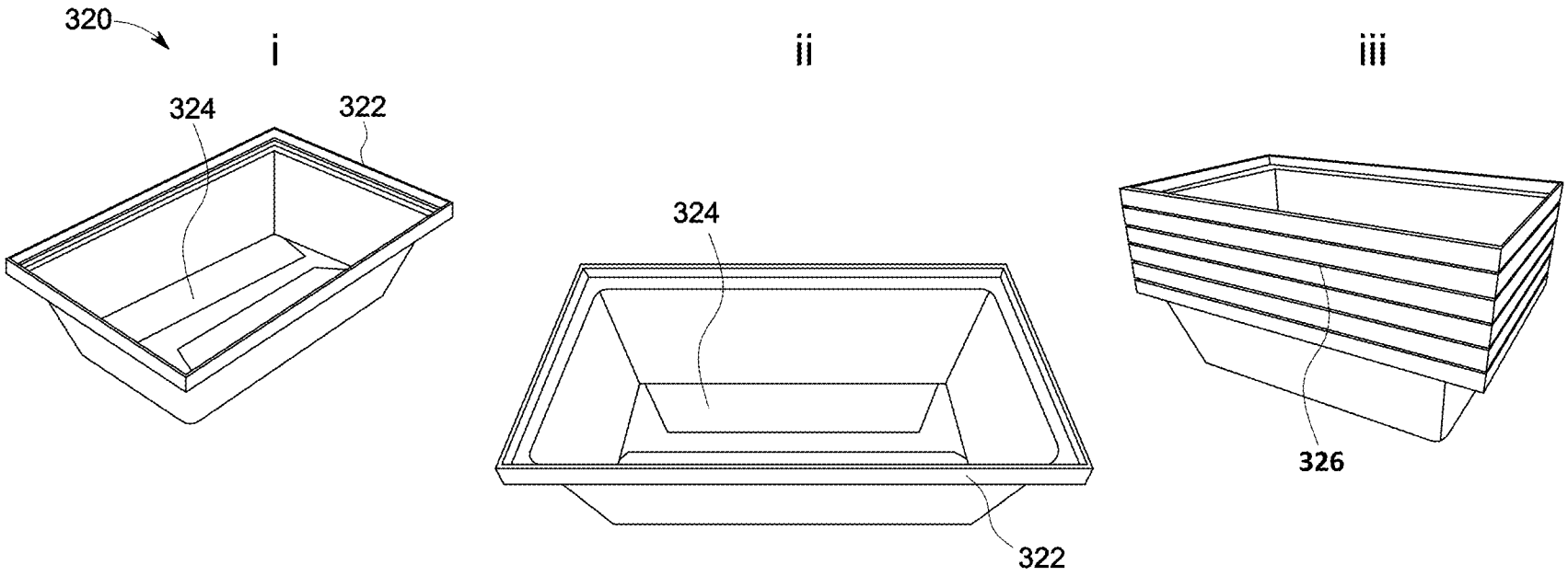
FIG. 3*c* schematically shows various views of scaffold(s), where each scaffold has a symmetrical trap door bottom, and are stackable, according to some embodiments.
Figure 4A:
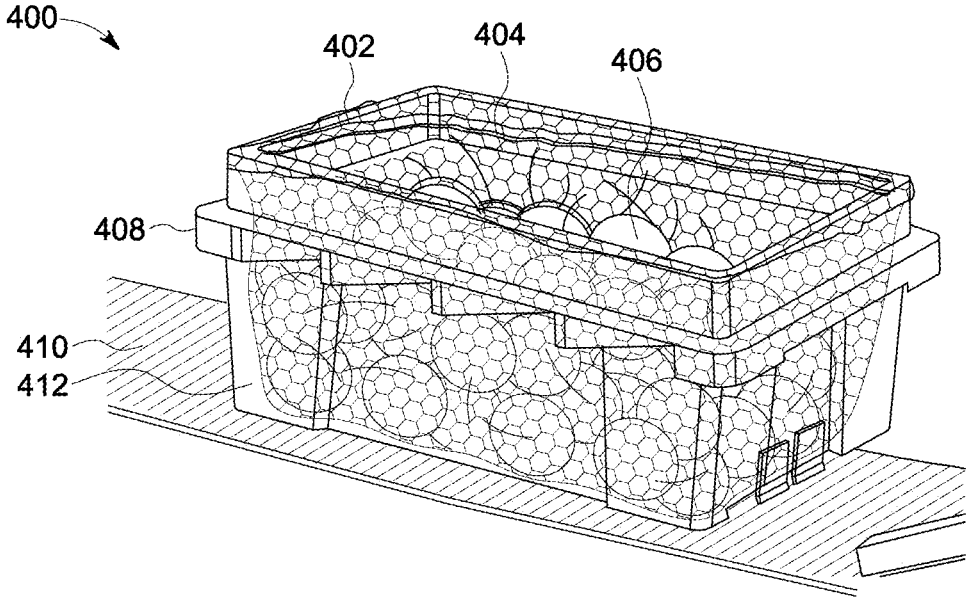
FIG. 4*a* schematically shows a perspective view of a scaffold with an aerated packaging material containing produce, where the scaffold has a rigid flap opening (shown in a closed configuration) at the bottom thereof according to some embodiments.
Figure 4B:
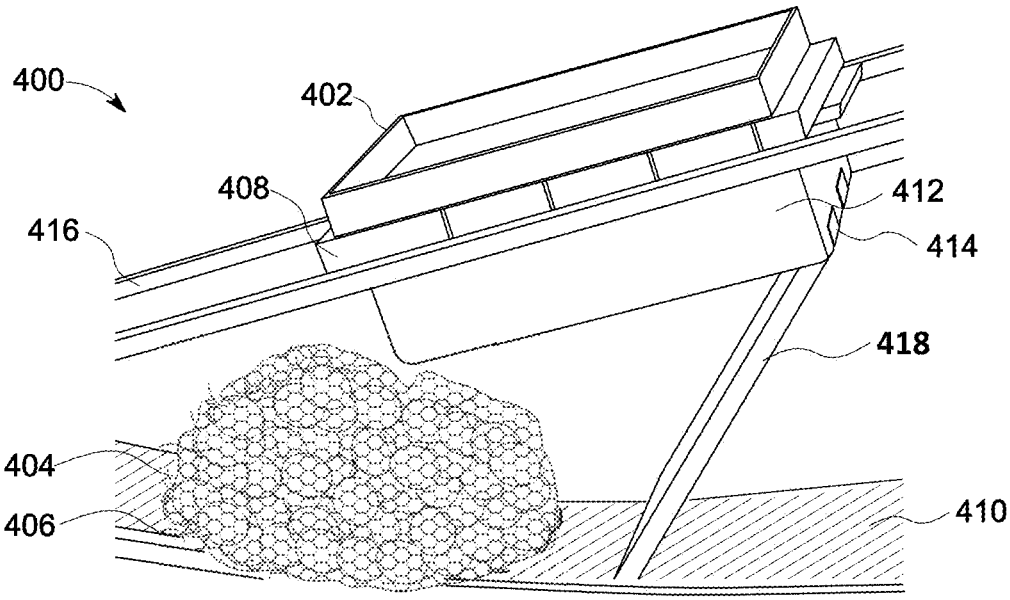
FIG. 4*b* schematically shows a perspective view of the scaffold of FIG. 4*a* where the rigid flap opening is shown in an open configuration, according to some embodiments.
Figure 4C:
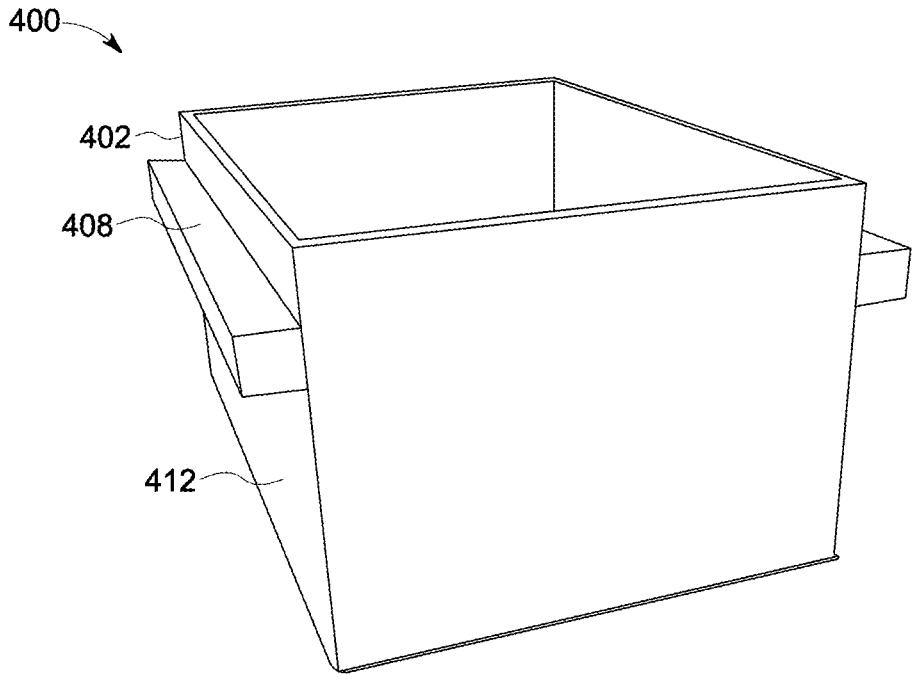
FIG. 4*c* schematically shows a perspective view of a scaffold for flow packaging produce, having a flap opening (shown in a closed configuration) at the bottom of the scaffold, according to some embodiments.
Figure 4D:
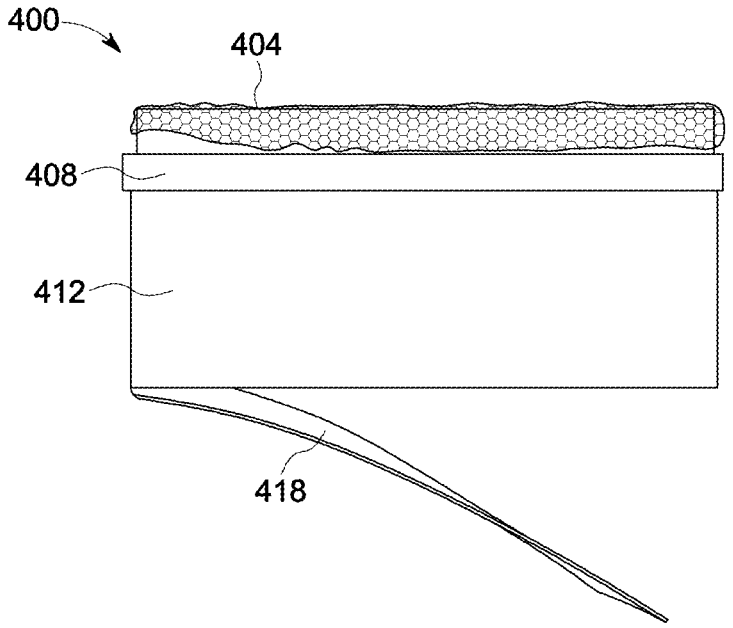
FIG. 4*d* schematically shows a side view of the scaffold of FIG. 4*c*, where the flap opening is shown in an open configuration, according to some embodiments.
Figure 4E:
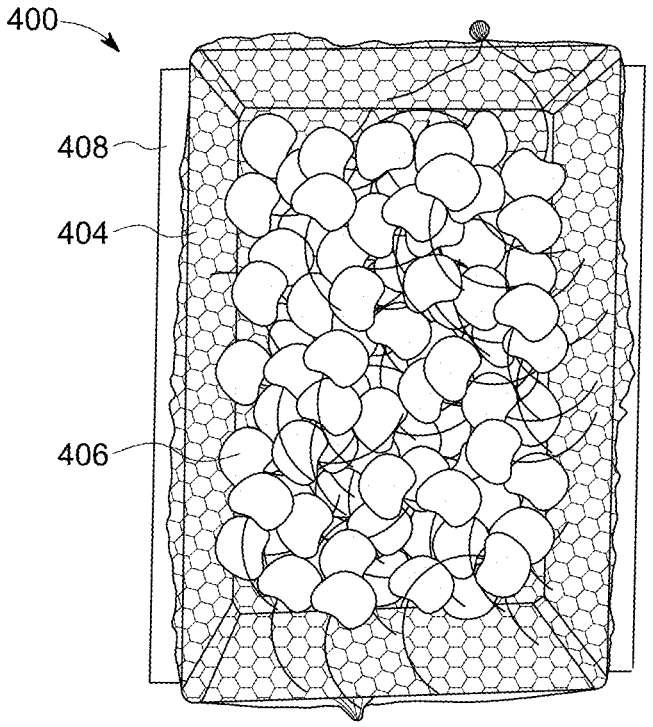
FIG. 4*e* schematically shows a top view of the scaffold of FIG. 4*c* with an aerated packaging material containing produce, according to some embodiments.
Figure 4F:
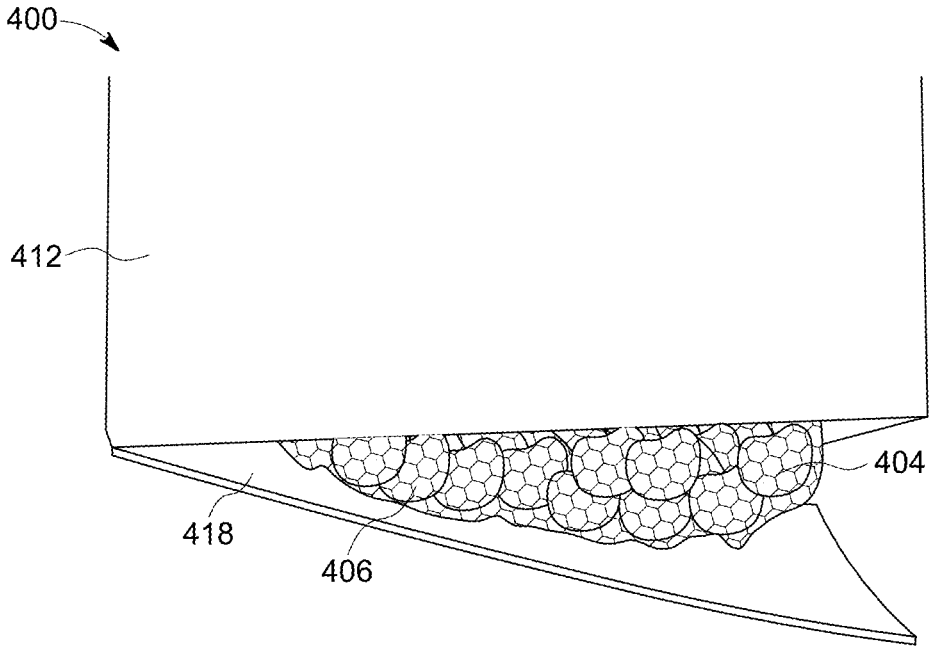
FIG. 4*f* schematically shows a side view of the scaffold of FIG. 4*d*, according to some embodiments.

FIG. 3*c* schematically shows various views of scaffold/s 320 for flow packaging produce, where each scaffold has a produce outlet opening which may include one or more doors 324 which may or may not be hinged, foldable, flaps, etc. e.g., a symmetrical trap door at the bottom, according to some embodiments. Optionally, the scaffold may include an upper edge or lip 322. Optionally, the upper edge may protrude. Optionally, the upper edge may be configured to be used as a rail, e.g., for lifting the scaffold. Optionally, the upper edge may be configured to be used to hold an aerated packaging material. Optionally, the scaffolds may be stackable 326. Optionally, the stacked scaffolds may be easily stored and/or transported. Optionally, the scaffold/s may be configured for use for transporting produce through a flow packing process, optionally with modified atmosphere properties.

FIG. 4*a-f* schematically show produce packaging system 400 including a scaffold 412 with an aerated packaging material 404 containing produce 406, where the scaffold 412 has a produce outlet opening 418 at the bottom, according to some embodiments. Optionally, the produce outlet opening 418 may have at least two configurations: which may be closed (as in FIG. 4*a*, FIG. 4*c*, and FIG. 4*e*), may be open (as in FIG. 4*b* and FIG. 4*d* or partially open as in FIG. 4*f*) Optionally, the produce outlet opening 418 may be held closed by placing the scaffold 412 onto a surface 410, e.g., a conveyer belt. Optionally, the base of the scaffold 412 may be connected to the base on the front edge of the scaffold by a hinge 414, glue, molding, etc. Optionally, the base of the scaffold may extend directly from the front wall of the scaffold, e.g., as one piece. Optionally, the base of the scaffold 412 may include a flap 418 or may be absent. Optionally, the base of the scaffold 412 may be removable. Optionally, the base and/or the flap 418 may include a flexible, semi-flexible and/or rigid material. Optionally, the base of the scaffold 412 may comprise a different material and/or a different weight of material to the rest of the scaffold 412. Optionally, the base and/or the flap 418 may be configured to assist in the gentle placement of the produce on to the conveyer belt 410 to reduce and/or prevent damage to the produce, e.g., bruising, breaking, splitting, etc.

For example, a scaffold 412 bearing an aerated packaging material 404 containing produce 406 may be lifted (for example, automatically lifted 416 by grasping and lifting the scaffold using one or more rails 408, indents or protrusions on one or more sides of the scaffold, which may be located below the upper edge 402 of the scaffold 412). The action of lifting the scaffold 412 may cause the aerated packaging material 404 bearing the contained produce 406 to drop gently through the produce outlet opening 418 at the front at the bottom of the scaffold 412 onto a conveyer belt 410. Optionally, the weight of the produce 406 may cause the aerated packaging material 404 to be released from the upper edges 402 of the scaffold, resulting in contraction of the opening (the mouth) of the aerated packaging material 404 (for example, by contraction of an elastic band and/or the aerated packing material), which may then enclose the produce 406.

Figure 5A:
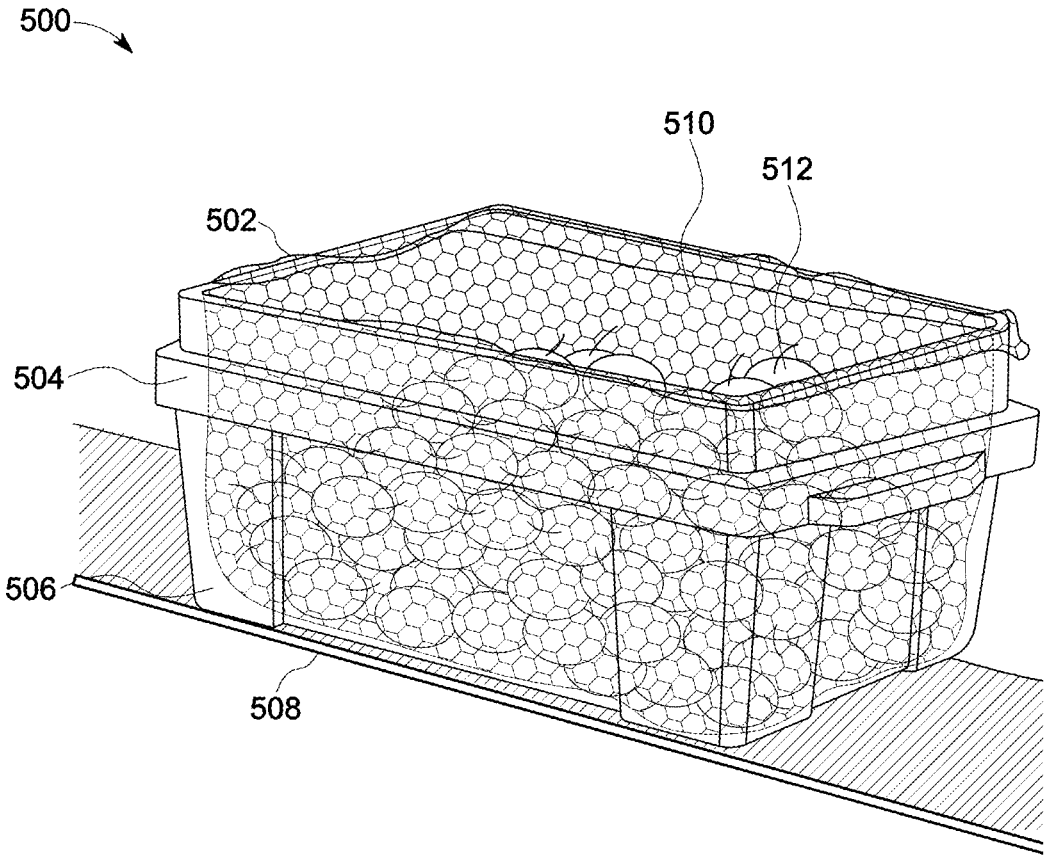
FIG. 5*a* schematically shows a perspective view of a scaffold with an aerated packaging material containing produce on a (flow) packaging conveyer belt, where the scaffold has an opening at the back wall (shown in a closed configuration), according to some embodiments.
Figure 5B:
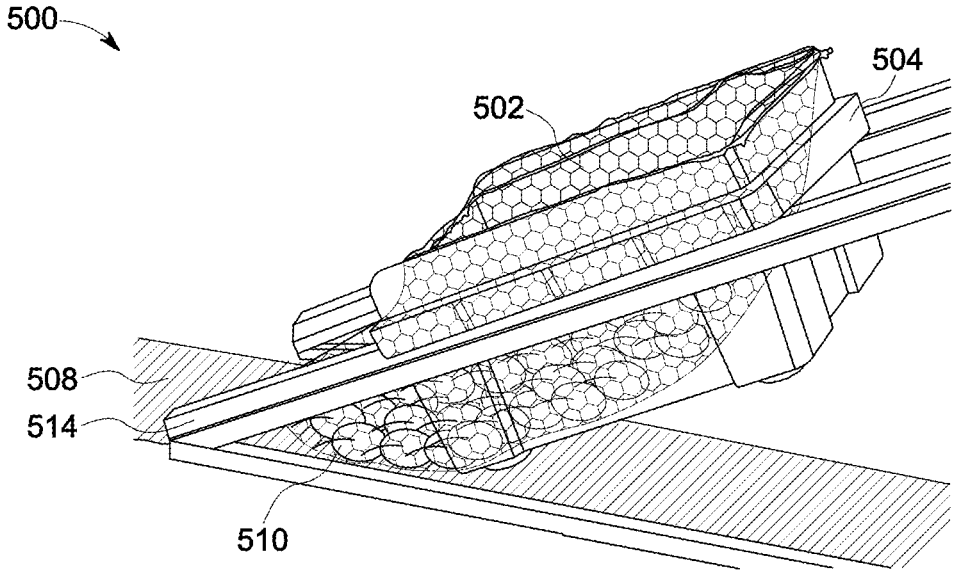
FIG. 5*b* schematically shows a perspective view of the scaffold of FIG. 5*a* where the back opening is shown in an open configuration, according to some embodiments.

FIG. 5*a* and FIG. 5*b* schematically show perspective views of produce packaging system 500 including a scaffold 506 with an aerated packaging material 510 containing produce 512 on a (flow) packaging conveyer belt 508, where the scaffold 506 has a produce outlet opening at the back wall (shown in a closed and an open configuration, respectively), according to some embodiments. Optionally, the produce outlet opening at the back wall of the scaffold 506 may be hinged, be a flap and/or the back wall may be absent.

For example, the scaffold 506 bearing the aerated packaging material 510 containing produce 512 may be lifted (for example, automatically lifted 514 by grasping and lifting the scaffold using one or more rails 504, indents or protrusions on one or more sides of the scaffold). The action of lifting the scaffold 506 may cause the aerated packaging material bearing the contained produce to drop gently through the produce outlet opening at the back of the scaffold 506 onto a conveyer belt 508. Optionally, the weight of the produce 512 may cause the aerated packaging material 510 to be released from the upper edges 502 of the scaffold 506, resulting in contraction of the opening (the mouth) of the aerated packaging material 510 (for example, by contraction of an elastic band and/or the aerated packing material), which may then enclose the produce 512.

Figure 6A:
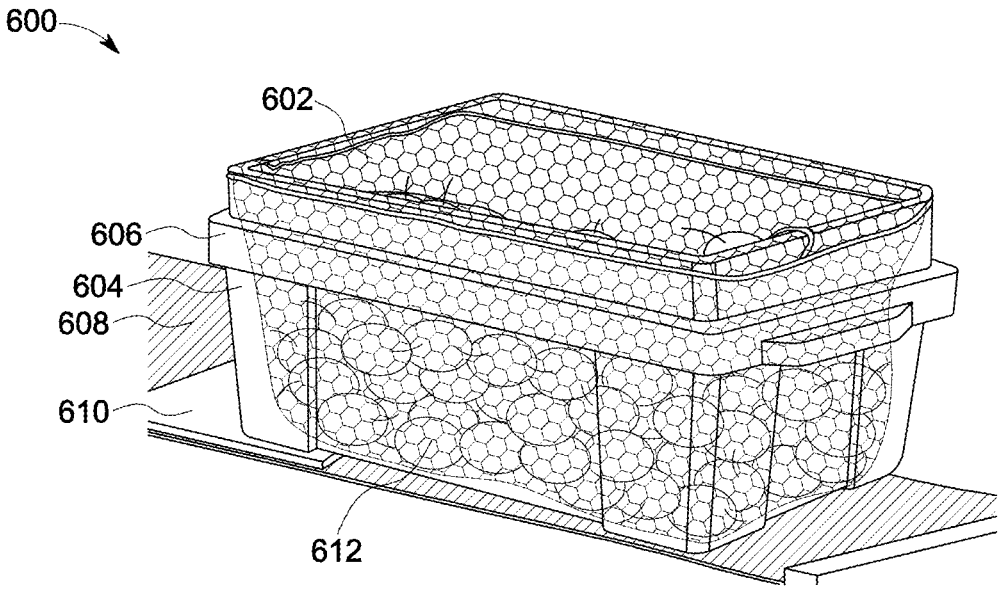
FIG. 6*a* schematically shows a perspective view of a scaffold with an aerated packaging material containing produce on a conveyer belt, where the scaffold has an opening at the back with support member at the bottom, according to some embodiments.
Figure 6B:
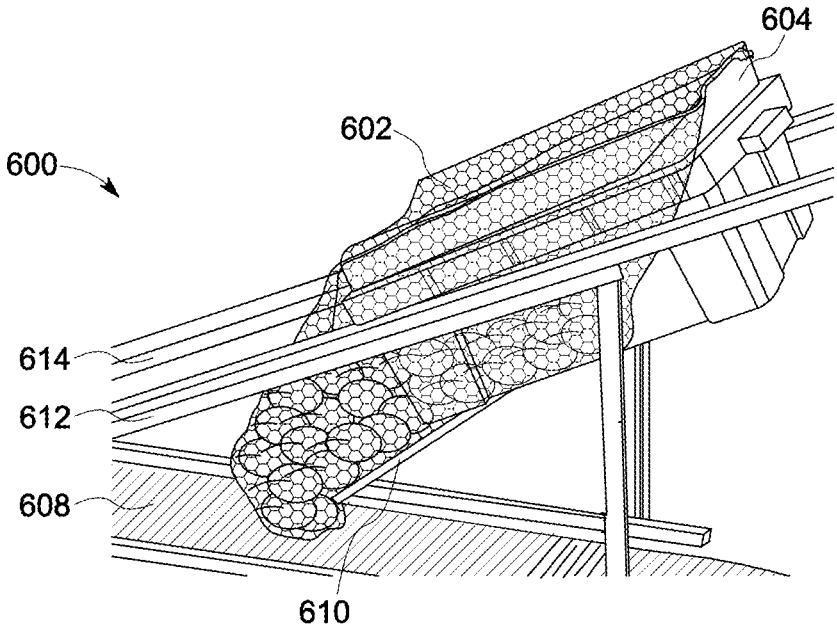
FIG. 6*b* schematically shows a perspective view of the scaffold of FIG. 6*a* as the produce exits the scaffold by sliding over the support member, according to some embodiments.
Figure 6C:
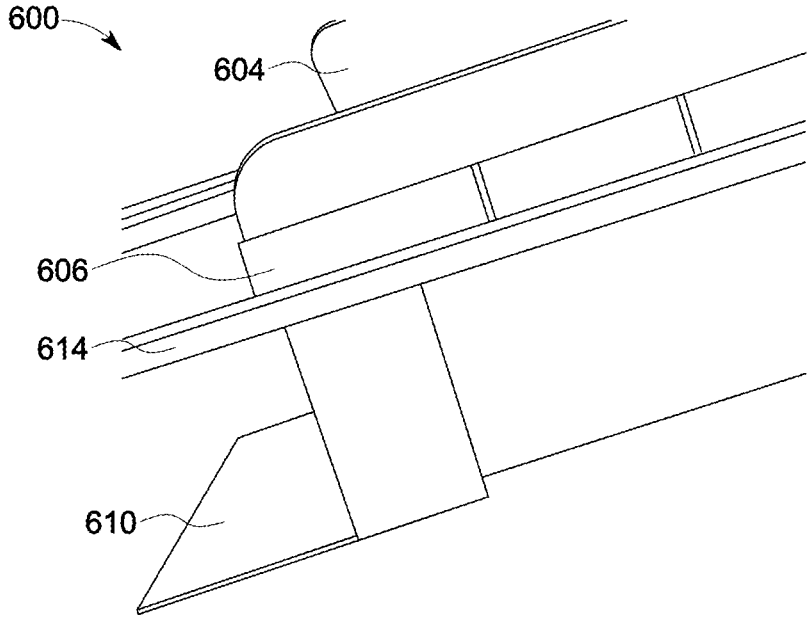
FIG. 6*c* schematically shows a perspective view of the scaffold of FIG. 6*b* without the produce, according to some embodiments.

FIG. 6*a-c* schematically show perspective views of a produce packaging system 600 including a scaffold 604 with an aerated packaging material 602 containing produce 612 used on a conveyer belt 608, where the scaffold 604 has a produce outlet opening at the back with a support member 610 at the bottom, according to some embodiments. Optionally, the produce outlet opening at the back of the scaffold 604 may be hinged, be a flap and/or the back wall may be absent. Optionally, the support member 610 may comprise a flexible, semi-flexible and/or rigid material. Optionally, the support member 610 may be comprised of different material and/or a different weight of material to the rest of the scaffold 604. Optionally, the support member 610 may extend directly from the base of the scaffold, e.g., as one piece. Optionally, the support member 610 may be removable. Optionally, the support member 610 may be configured to assist in the gentle placement of the produce 612 onto the conveyer belt 608 to reduce and/or prevent damage to the produce, e.g., bruising, breaking, splitting, etc.

For example, a scaffold 604 bearing an aerated packaging material 602 containing produce may be lifted (for example, automatically lifted 614 by grasping and lifting the scaffold using one or more rails 606, indents or protrusions on one or more sides of the scaffold). The action of lifting the scaffold 604 may cause the aerated packaging material 602 bearing the contained produce 612 to slide over the support member 610 and out through the produce outlet opening at the rear of the scaffold 604 onto a conveyer belt 608. Optionally, the weight of the produce 612 may cause the aerated packaging material 602 to be released from the upper edges of the scaffold 604, resulting in contraction of the opening (the mouth) of the aerated packaging material 602 (for example, by contraction of an elastic band and/or the aerated packing material), which may then enclose the produce 612.

Figure 7:
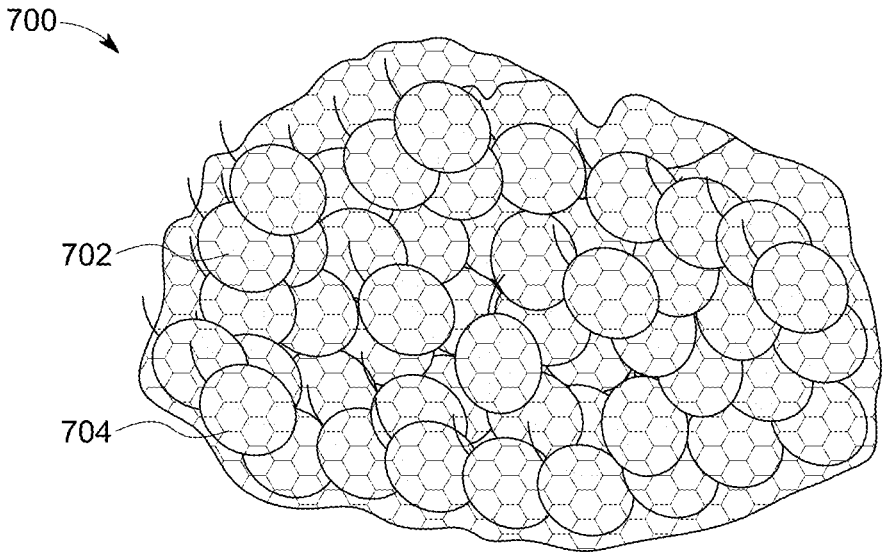
FIG. 7 shows a picture of the aerated packing material, filled with produce (e.g., cherries), upon removal of the scaffold, according to some embodiments.

FIG. 7 shows a schematic illustration of a produce packaging system 700 including the aerated packing material 702, filled with produce 704, upon removal of the scaffold, according to some embodiments. By removal of the scaffold, the elastic opening of the aerated packaging material 702 may be released, enclosing the produce 704 within the aerated packaging material which may be in preparation for sealing by flow packing.

Figure 8:
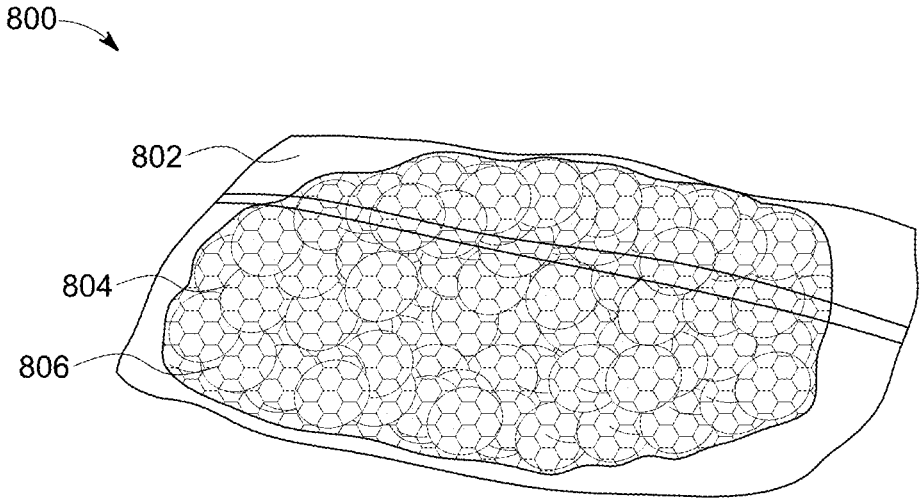
FIG. 8 shows a picture of the final packaged product, wherein the aerated packaging material containing produce (the configuration of FIG. 7) is sealed in a polymer packaging following flow packing, optionally with modified atmosphere properties, according to some embodiments.

FIG. 8 shows a schematic illustration of a produce packaging system 800 including the final packaged product, wherein the aerated packaging material 804 containing the produce 806 (e.g., in the configuration of FIG. 7) may be sealed in a polymer packaging 802 following flow packing, according to some embodiments. Optionally, the flow packing may take place under a modified atmosphere. Optionally, upon sealing, the final package may be ready for distribution.

For example, the aerated packaging material as shown in FIG. 1 may include an elastic band that can be pulled over and around the upper edge of a scaffold, for example of a box. Produce (for example, cherries, or any type of produce) are placed inside the aerated packaging material, which in turn may be configured to freely close upon release from the upper edge of the scaffolding via the produce outlet opening. This action may contain the produce inside the subsequently closed aerated packing material, as shown in FIG. 7. The released aerated packing material-enclosed produce may then be ready to be conveyed to flow packing, whereupon sealing with a polymer packaging, as shown in FIG. 8, results in the final package which may be suitable for distribution.

Figure 9A:
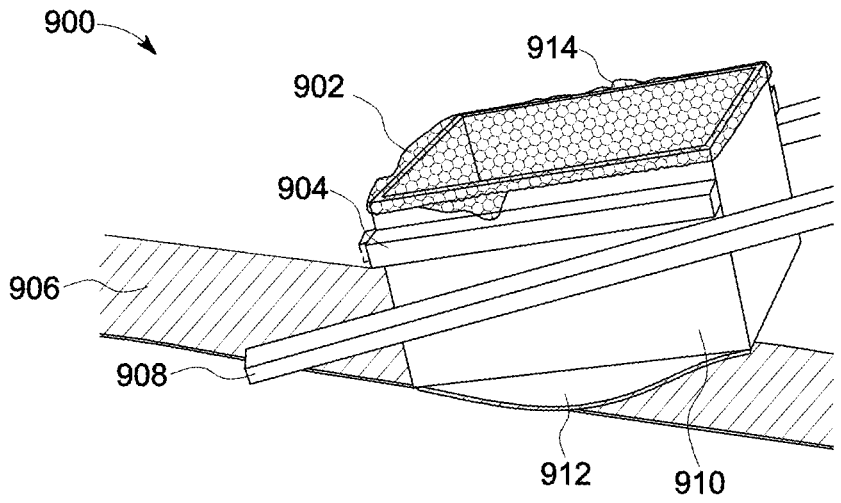
FIG. 9*a* schematically shows perspective view of a scaffold with an aerated packaging material containing produce, where the scaffold has an opening at the bottom, which is slightly open, according to some embodiments.
Figure 9B:
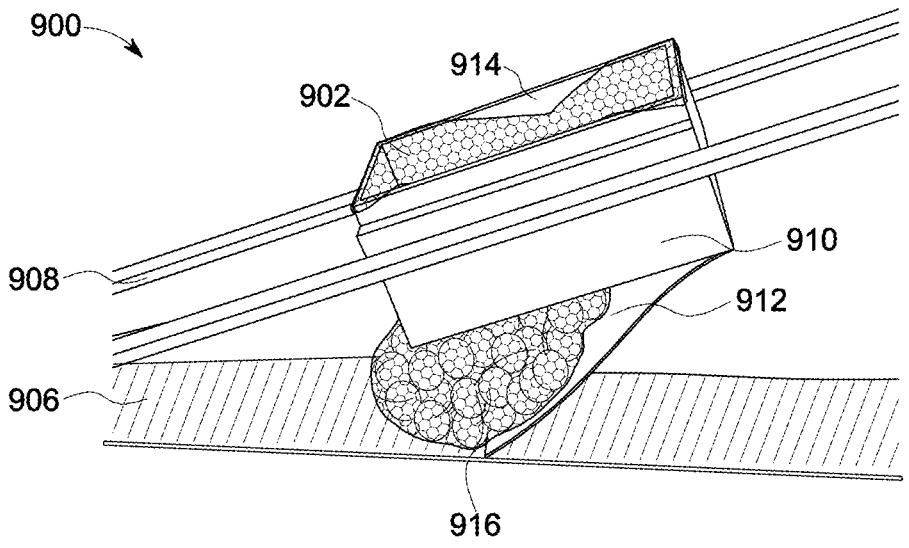
FIG. 9*b* schematically shows perspective view of the scaffold of FIG. 9*a* where the scaffold opening at the bottom is partially open, according to some embodiments.
Figure 9C:
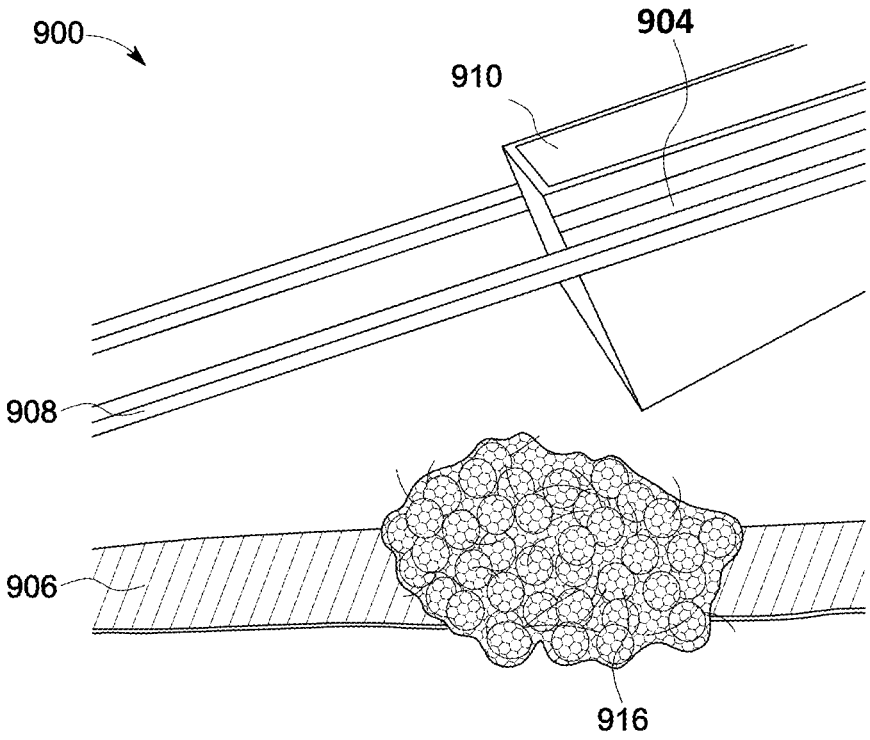
FIG. 9*c* schematically shows perspective view of the aerated packaging material containing produce deposited on a conveyer belt and the scaffold continues on the rails, optionally for reuse, according to some embodiments.

FIG. 9*a-c* schematically show perspective views of a produce packaging system 900 including a process for using a scaffold with an aerated packaging material containing produce, where the scaffold may have a produce outlet opening e.g., at the rear and/or front and/or at the bottom, according to some embodiments. For example, a scaffold 910 bearing an aerated packing material 902 containing produce 916 may be lifted (for example, automatically lifted 908 by grasping and lifting the scaffold using one or more rails 904, indent or protrusions on one or more sides of the scaffold). The action of lifting the scaffold 910 may cause the aerated packing material 902 bearing the contained produce 916 to push open the base 912 of the scaffold, and to gently deposit the aerated packing material 902 bearing the contained produce 916 through the produce outlet opening onto a conveyer belt 906. Optionally, the weight of the produce 916 may cause the aerated packing material 902 to be released from the upper edges 914 of the scaffold 910, resulting in contraction of the opening (the mouth) of the aerated packing material (for example, by contraction of an elastic band and/or the aerated packing material), which may then enclose the produce 916. The aerated packaging material containing produce 916 deposited on conveyer belt 906 may continue for further packaging and/or which may be placed in an outer carton and palletized for distribution, while the scaffold may continue on the rails, optionally for reuse.

Figure 10:
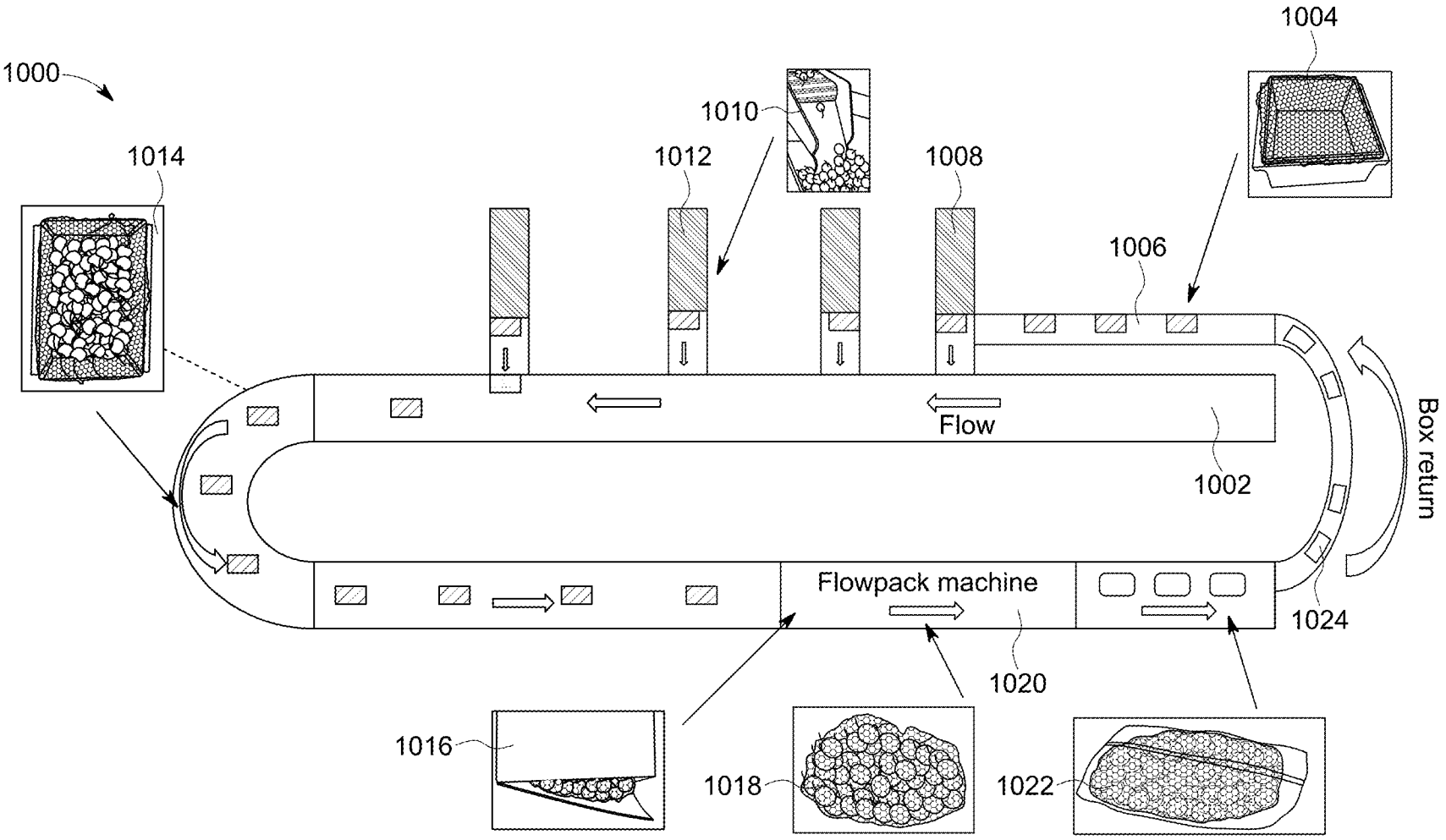
FIG. 10 shows a scheme of an overall workflow of produce packaging, according to some embodiments.

Reference is now made to FIG. 10, which schematically shows the workflow process 1000 of packaging produce, according to some embodiments. For example, the first step 1004 (similar to that shown in FIG. 4) shows the beginning of the process, wherein aerated packaging material is placed over scaffolds 1006. The scaffolds may include a produce outlet opening having e.g., a trap door (e.g., similar to the scaffolds shown in FIG. 3*a-c*, 4*a-f*, 5*a-b* and/or 6*a-c*) and may be placed 1008 manually and/or automatically on a conveyer belt 1002. In the second step, produce 1010 (in this case cherries) may be deposited into the aerated packaging material inside the scaffold 1012. In the third step 1014, the scaffolds bearing the aerated packaging material and produce may proceed on the conveyer belt as single units to the flow pack machine 1020, whereupon the scaffolds may be lifted. The action of lifting the scaffolds may cause the aerated packaging material enclosed produce to be dropped through the produce outlet opening 1016 and, optionally simultaneously, the aerated packaging material may be released from the scaffolds' upper edges, which may cause the mouth of the aerated packaging material to contract and enclose the produce 1018. The constrained produce may be enclosed by the aerated packaging material, may then be sealed by further packaging in the flow pack machine, resulting in a final package 1022 which may be placed in an outer carton and palletized for distribution. Optionally, the empty scaffolds may be reused by returning them to the starting point 1024, e.g., either manually, and/or by continuing along the conveyer belt, e.g., using an overhead conveyer belt.

Figure 11:
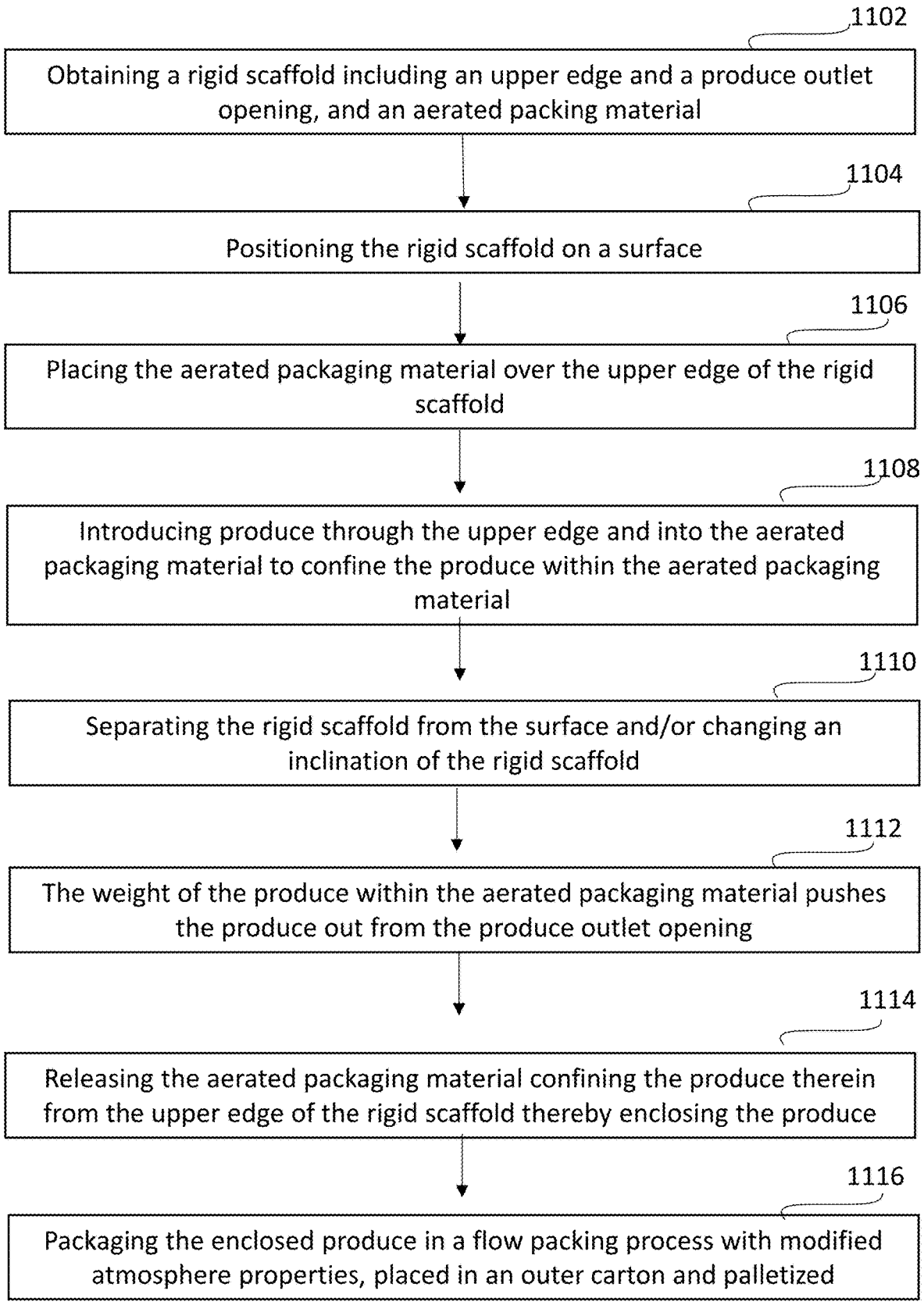
FIG. 11 is a flow chart of a workflow of produce packaging, according to some embodiments.

According to some embodiments, the flow packaging process may include modified atmosphere properties (MAP), which may increase the shelf life of the produce. FIG. 11 is a flow chart of a workflow of produce packaging, according to some embodiments. For example, the packaging process may include obtaining 1102 a scaffold including an upper edge and a produce outlet opening, and an aerated packing material, positioning 1104 the scaffold on a surface, placing 1106 the aerated packaging material over the upper edge of the scaffold, introducing 1108 produce through the upper edge and into the aerated packaging material to confine the produce within the aerated packaging material, separating 1110 the scaffold from the surface and/or changing an inclination of the scaffold, wherein the weight of the produce within the aerated packaging material pushes 1112 the produce out from the produce outlet opening, thereby releasing 1114 the aerated packaging material confining the produce therein from the upper edge of the scaffold and enclosing the produce. The produce enclosed in the aerated packaging material may be further packaged 1116 in a flow pack process, optionally with modified atmosphere properties, resulting in a final package, which may be placed in an outer carton and palletized for distribution. Optionally, flow pack process with modified atmosphere properties may extend the shelf-life of the produce. Unless defined otherwise, all technical and scientific terms used herein have the same meaning as commonly understood by one of ordinary skill in the art to which the invention pertains.

The term "a" and "an" refers to one or to more than one (i.e., to at least one) of the grammatical object of the article. By way of example, "an element" means one element or more than one element.

The term "about" when referring to a measurable value such as an amount, a temporal duration, and the like, is meant to encompass variations of ±20% or in some instances 10%, or in some instances ±5%, or in some instances ±1%, or in some instances ±0.1% from the specified value, as such variations are appropriate to perform the disclosed methods. Each possibility is a separate embodiment. The following examples are presented in order to more fully illustrate some embodiments of the invention. They should in no way be construed, however, as limiting the broad scope of the invention. One skilled in the art can readily devise many variations and modifications of the principles disclosed herein without departing from the scope of the invention.

What is claimed is:

1. A produce packaging system configured to facilitate enclosing produce within an aerated packaging material, the aerated packaging material being configured to spontaneously close, the system comprising:

a scaffold comprising an upper edge and a closeable produce outlet opening, the upper edge being configured to hold open the aerated packaging material so as to receive and confine the produce therewithin when the produce outlet opening is in a closed configuration; and a conveyer system configured to facilitate transitioning the produce outlet opening from its closed configuration to an open configuration thereof, facilitating exiting of the produce confined within the aerated packaging material through the produce outlet opening and releasing the aerated packaging material from the upper edge, thereby allowing the aerated packaging material to spontaneously close thus enclosing the product therewithin.

2. The system according to claim 1, wherein the conveyer system is configured to facilitate transitioning the produce outlet opening from its closed position to its open position by lifting the scaffold from a surface.

3. The system according to claim 1, wherein the aerated packaging material comprises an elastic material, wherein contraction of the elastic material facilitates closing the aerated packaging material.

4. The system according to claim 1, wherein the aerated packaging material is a net, bag, or pouch.

5. The system according to claim 1, wherein the aerated packaging material is composed of a polymer, woven natural material, fibers, flax, hemp, straw, cotton, silk, or any combination thereof.

6. The system according to claim 1, wherein the produce outlet opening is a front opening, rear opening, side opening, bottom opening or any combination thereof.

7. The system according to claim 1, wherein the produce outlet opening comprises a door, flap, trap door, at least partial absence of a side, front, rear or bottom of the scaffold, wherein the door, flap or trap door comprises a flexible, semi-flexible or rigid material.

8. The system according to claim 1, wherein the produce outlet opening comprises a produce support ramp extending from the scaffold and configured to dampen the exit of the produce enclosed within the aerated packaging material through the produce outlet opening.

9. The system according to claim 1, wherein the scaffold has at least one rail protruding from, indented within or attached to an outer surface of the scaffold, wherein the at least one rail is configured to support the scaffold when the produce outlet opening is in its closed configuration, in its open configuration, and/or in a transition between its closed and the open configurations.

10. The system according to claim 1, wherein the scaffold is constructed from plastic, cardboard, wood, metal, silicone, or any combination thereof.

11. The system according to claim 1, wherein the scaffold is reusable.

12. A method for packaging produce within an aerated packaging material, the aerated packaging material being configured to spontaneously close, the method comprising:

positioning on a surface, a scaffold comprising an upper edge and a produce outlet opening wherein the produce outlet opening is a front opening, rear opening, side opening, bottom opening or any combination thereof;

placing an aerated packaging material over the upper edge of the scaffold so as to hold open the aerated packaging material;

introducing produce through the upper edge and into the aerated packaging material, such that the produce is confined within the aerated packaging material;

separating the scaffold from the surface, such that a weight of the produce pushes the produce confined within the aerated packaging material out from the produce outlet opening, thereby releasing the aerated packaging material confining the produce therein from the upper edge of the scaffold, thereby allowing the aerated packaging material to spontaneously close thus enclosing the produce therein.

13. The method according to claim 12, wherein the produce outlet opening is located on the bottom of the scaffold opposing the upper edge and wherein the produce outlet opening is blocked when the scaffold is placed on the surface, wherein upon separating between the scaffold and the surface, the produce outlet opening is unblocked allowing the weight of the produce within the aerated packaging material to push the enclosed produce out therethrough.

14. The method according to claim 13, wherein separating between the scaffold and the surface is performed by lifting the scaffold and/or supporting the scaffold while removing the surface on which the scaffold is positioned.

15. The method according to claim 13, wherein the produce outlet opening is located on a front, rear or side of the scaffold essentially perpendicularly to the upper edge and wherein the produce within the aerated packaging material is maintained within the scaffold when the scaffold is placed horizontally on the surface, wherein upon changing the inclination of the scaffold, the weight of the produce within the aerated packaging material pushes the enclosed produce out from the produce outlet opening.

16. The method according to claim 12, wherein the produce outlet opening comprises a door, flap, trap door, at least partial absence of a side, front, rear or bottom of the scaffold, wherein the door, flap or trap door comprises a flexible, semi-flexible or rigid material.

17. The method according to claim 12, wherein the scaffold is reusable and wherein the method further comprising returning the scaffold, emptied of the enclosed produce, to the start of the process.

* * * * *